United States Patent [19]

Tibbitts

[11] Patent Number: 4,976,324

[45] Date of Patent: Dec. 11, 1990

[54] DRILL BIT HAVING DIAMOND FILM CUTTING SURFACE

[75] Inventor: Gordon A. Tibbitts, Salt Lake City, Utah

[73] Assignee: Baker Hughes Incorporated, Houston, Tex.

[21] Appl. No.: 411,419

[22] Filed: Sep. 22, 1989

[51] Int. Cl.[5] ..... E21B 10/46; E21B 10/52

[52] U.S. Cl. ..... 175/329; 175/410

[58] Field of Search ..... 175/329, 410, 411, 409, 175/374, 375; 204/192.15, 192.16; 428/408

[56] References Cited

U.S. PATENT DOCUMENTS

| | | | |
|---|---|---|---|
| 4,486,286 | 12/1984 | Lewin et al. | 204/192 |
| 4,504,519 | 3/1985 | Zelez | 427/39 |
| 4,603,082 | 7/1986 | Zelez | 428/336 |
| 4,604,106 | 8/1986 | Hall et al. | 175/329 X |
| 4,605,343 | 8/1986 | Hibbs, Jr. et al. | 175/329 X |
| 4,645,977 | 2/1987 | Kurokawa et al. | 315/111.21 |
| 4,698,256 | 10/1987 | Giglia et al. | 428/216 |
| 4,699,227 | 10/1987 | Wardley | 175/329 |
| 4,707,384 | 11/1987 | Schachner et al. | 427/249 |
| 4,726,718 | 2/1988 | Meskin et al. | 175/329 X |
| 4,728,529 | 3/1988 | Etzkorn et al. | 427/39 |

OTHER PUBLICATIONS

Spitsyn, B. V., L. L. Bouilov & B. V. Derjaguin, "Vapor Growth of Diamond on Diamond and Other Surfaces", *Journal of Crystal Growth 52* (1981), pp. 219–226, North-Holland Pub. Co.

*Primary Examiner*—Stephen J. Novosad
*Attorney, Agent, or Firm*—Joseph A. Walkowski

[57] ABSTRACT

An improved diamond drill bit is provided which has a diamond film cutting surface. The drill bit comprises a body member and a plurality of cutting members, each including a diamond cutting face formed from a diamond substrate coated with a diamond film.

24 Claims, 1 Drawing Sheet

DRILL BIT HAVING DIAMOND FILM CUTTING SURFACE

BACKGROUND OF THE INVENTION

The present invention relates generally to drill bits used in the oil and gas industry. More particularly, the invention relates to drill bits having diamond cutting surfaces.

Drill bits presently known to the industry which utilize either natural or synthetic diamonds as the cutting elements in the stationary cutting members are generally known as "diamond bits." References herein to "diamond bits" or "diamond drill bits" refer to all types of bits generally used in the oil and gas industry, for either drilling or coring, having primarily stationary diamond cutting members.

Conventional diamond drill bits have a variety of different types of cutting surfaces, for example, polycrystalline diamond compact (PDC) cutters, thermally stable diamond product (TSP) cutters, mosaic-type cutters, natural diamonds and diamond impregnated stud cutters. Mosaic cutters are typically formed of a plurality of geometrically-shaped thermally stable diamond elements cooperatively arranged and bonded in a desired shape, to form a unitary cutting surface.

In conventional diamond bits, the diamond cutting surface is typically bonded to a supporting member which is then secured to a carrier member which facilitates attachment to the drill bit. The cutting surface is preferably connected to the supporting member by brazing or sintering. Preferably, the supporting member and the carrier member are formed of a suitable hard or sintered metal such as tungsten carbide. The supporting member can be soldered or otherwise connected, such as by form sintering or hot isostatic pressing, to the carrier member. A discussion of such a conventional structure is found in U.S. Pat. No. 4,498,549 issued Feb. 12, 1985 which is hereby incorporated herein for all purposes.

PDC diamond cutting elements can be made by forming an amalgam of polycrystalline sintered diamond and cobalt carbide which is sintered into disk shapes. Such diamond elements are commercially manufactured by the General Electric Company under the trademark STRATAPAX. These diamond elements are bonded, usually by a diamond press, to a cobalt carbide slug and sold as an integral slug cutter. The slug cutters are then attached by the drill bit manufacturers to a tungsten carbide slug which is fixed within a drill bit body according to the design of the bit manufacturer.

It has been proposed that improved drill bits can be formed by applying a layer of polycrystalline diamond by chemical vapor deposition onto a substrate of one of: (a) a metal bonded hard material compound; (b) a ceramic material; or (c) a metal or alloy. Such a concept is disclosed in U.S. Pat. No. 4,707,384 to Schachner, et al. Methods of forming diamond films and layers are disclosed in U.S. Pat. No. 4,707,384, the teachings of which are incorporated herein by reference.

Various methods have been devised for forming diamond films or coatings. One such method is disclosed in U.S. Pat. No. 4,707,384. Another method is disclosed by E. V. Spitsyn, et al., "Vapor Growth of Diamond on Diamond and Other Surfaces" J. of Crystal Growth 52, pp. 219–226 (1981). Additional methods are disclosed in U.S. Pat. Nos. 4,486,286, 4,504,519, and 4,645,977.

Continual efforts are being made to improve diamond bit technology and develop improved diamond cutting elements. It would be a significant advancement in the art to provide a diamond cutting element in which fracture resistance is greatly increased, the coefficient of friction of the cutting element surface is markedly reduced to promote separation of formation cuttings from the cutting element, and the cutting point or edge stays sharp longer than currently available elements. Such a diamond cutting element is disclosed and claimed herein.

SUMMARY OF THE INVENTION

In a preferred embodiment of the present invention, the diamond cutting surface of a diamond bit is improved by coating it with a diamond film. In the preferred embodiment, the film is formed by chemical vapor deposition. The diamond film has a lower porosity or higher purity than the diamond substrate. This improves the quality of the cutter's leading edge and helps to resist wear in addition to improving impact resistance and lowering the cutter's frictional coefficient. In one embodiment, the diamond film is formed on a polycrystalline diamond compact cutter. In another embodiment the diamond film is formed on a thermally stable diamond product cutter element.

DETAILED DESCRIPTION OF THE PREFERRED EMBODIMENTS

The present invention provides an improved diamond drill bit wherein the improvement lies in the surface of the diamond cutting element. The invention is best understood by reference to the attached drawings.

Figure 1:
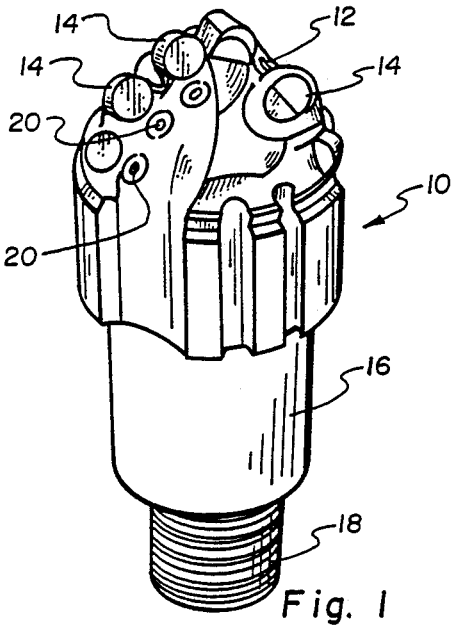
FIG. 1 is a perspective illustration of a diamond drill bit having cutting members in accordance with the present invention.

Referring first to FIG. 1, an exemplary embodiment of a drill bit 10 in accordance with the present invention is illustrated. Drill bit 10 includes a body section 12 which carries a plurality of cutting members 14. Body 12 is preferably a molded component fabricated through conventional metal matrix infiltration technology. Body 12 is coupled to a shank 16 which includes a threaded portion 18 for connection to a standard drill stem. Shank 16 and body 12 are preferably formed to be functionally integral with one another. Drill bit 10 includes an internal passage (not illustrated) through which hydraulic fluid can flow. A plurality of nozzles 20 are formed in body 12 to distribute hydraulic fluid from the passage proximate the faces of cutting members 14.

Figure 2:
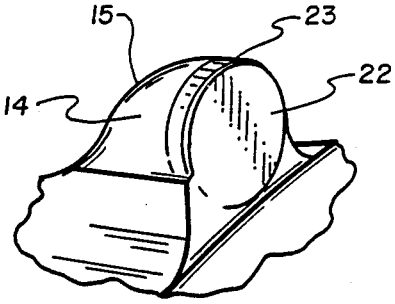
FIG. 2 is a perspective illustration of an isolated cutting member of the drill bit of FIG. 1.

Reference is next made to FIG. 2 in which cutting member 14 is illustrated in greater detail. A diamond cutting face 22 secured to a supporting member 23 of similar configuration and generally formed of tungsten or silicon carbide is positioned on the front of carrier member 15. Carrier member 15 provides mechanical support and orientation for cutting face 22. In the embodiment illustrated in FIG. 2, cutting face 22 is shaped as a circular disk. Carrier member 15 is preferably formed from a suitable hard material such as tungsten carbide. Cutting face 22 is attached to carrier member 15 via substrate 23 through use of a suitable process such as brazing or sintering, both well known to those skilled in the art.

Figure 3A:
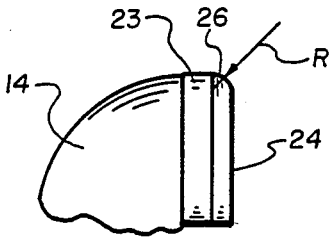
FIGS. 3A and 3B illustrate prior art cutting elements.
Figure 3B:
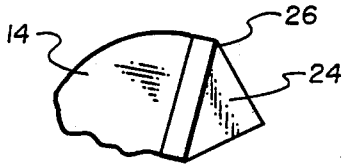

Reference is next made to FIG. 3A which illustrates a prior art cutting member 14. A diamond element 24 is secured to the front of supporting member 23 of cutting member 14. Element 24 comprises a polycrystalline diamond compact. As drill bit 10 progresses into a formation, the leading cutting edge 26 of diamond element 24 begins to wear away as illustrated by radius R. FIG. 3B depicts diamond element 24 as a triangular TSP which has been furnaced to form cutting member 14 directly into the matrix of body section 12 of bit 10. Again, it can be appreciated that cutting edge 26 at the apex of element 24 will wear to a fairly large radius.

Figure 4A:
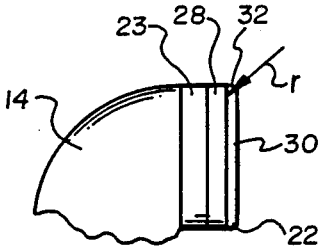
FIGS. 4A and 4B illustrate preferred embodiments of cutting elements according to the present invention.

Reference is now made to FIG. 4A which illustrates a preferred embodiment of the present invention. Cutting face 22 attached to cutting member 14 is comprised of a diamond substrate 28 and a diamond film 30. Diamond substrate 28 is similar to diamond element 24 of FIG. 3A and is attached to supporting member 23. However, diamond film 30 has been applied to the cutting surface of substrate 28 by a suitable method such as chemical vapor deposition. As bit 10 progresses through a rock formation, the leading cutting edge 32, substantially comprising diamond film 30, wears away around radius r. Radius r of FIG. 4A is less than radius R of FIG. 3A. Since film 30 has a lower porosity or higher purity than substrate 28, film 30 wears away at a slower rate than the substrate would, thereby helping cutting face 22 stay sharp longer. In the embodiment illustrated in FIG. 4A, substrate 28 is formed from a polycrystalline diamond compact.

It should be noted that film 30 also reduces the surface porosity of substrate 28 and fills the anomolies which are nucleation points for fracture, thus increasing the substrate's toughness and reducing friction during cutting of the formation.

Figure 4B:
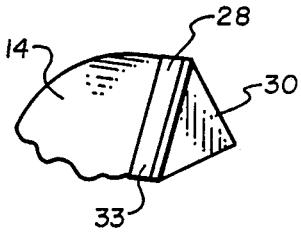

In FIG. 4B, substrate 28 comprises a triangular TSP which has a diamond film 30 applied to its front face. Side faces 33 of substrate 28 can also be coated to reduce friction between cutting member 14 and the formation.

Figure 5:
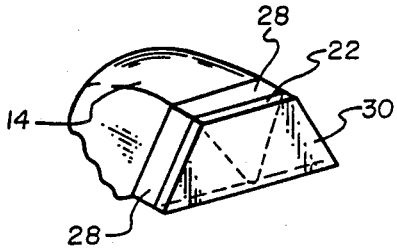
FIG. 5 illustrates an alternative preferred embodiment of the cutting element of the present invention.

FIG. 5 illustrates another preferred embodiment similar to FIG. 4B except that cutting face 22 is of mosiac construction, formed of triangular shaped TSP's rather than a unitary element. Elements 28 are TSP's similar to that of FIG. 4B, but furnaced into the bit 10 or to a carrier member as a group. Such grouped elements can simulate a larger cutter for far less cost and are particularly effective in harder, more abrasive formations in comparison to PDC's. However, of necessity there are hairline joints between each TSP on cutting face 22, shown as broken lines under film 30. Film 30, not only reduces surface porosity of elements 28 but also fills the joints elements 28, providing a much more uniform abrasion and erosion resistant cutting face 22.

As can be seen from the foregoing, the present invention provides an improved diamond cutting element for a diamond drill bit in which the cutting edge will stay sharp longer and provide improved cutting characteristics, and in which the wear and impact resistance of the cutting element is enhanced. This advantage is obtained by forming a diamond film on the diamond cutting surface of a diamond bit.

While the invention has been described with respect to the presently preferred embodiments, it will of course be appreciated by those skilled in the art that modifications or changes can be made to the illustrated embodiments of the present invention without departing from its spirit or essential characteristics. For example, the size and shape of the diamond cutting elements could be changed. The invention can also be used on other types of diamond substrates, such as natural diamond or diamond-impregnated tungsten carbide. Accordingly, all modifications or changes which come within the meaning and range of equivalence of the claims are to be embraced within their scope.

What is claimed is:

1. A drill bit for earth boring, comprising:
a body member; and
a plurality of cutting members disposed on and protruding from the surface of said body member, said cutting members including diamond cutting faces comprising a diamond substrate coated with a diamond film.

2. A drill bit as defined in claim 1 wherein said diamond substrate comprises a polycrystalline diamond compact.

3. A drill bit as defined in claim 1 wherein said diamond substrate comprises a thermally stable diamond product.

4. A drill bit as defined in claim 1 wherein said diamond substrate comprises a unitary piece of diamond.

5. A drill bit as defined in claim 1 wherein said diamond substrate comprises a plurality of diamond pieces.

6. A drill bit as defined in claim 5 wherein said film covers joints between said diamond pieces.

7. A drill bit as defined in claim 1 wherein said diamond film is formed by chemical vapor deposition.

8. A drill bit as defined in claim 1 wherein said diamond film also coats exposed sides of said cutting members.

9. A cutting member for an earth boring drill bit comprising:
a supporting structure; and
a cutting face secured to said supporting structure, said cutting face comprising a diamond substrate coated with a diamond film.

10. A cutting member as defined in claim 9 wherein said diamond substrate comprises a polycrystalline diamond compact.

11. A cutting member as defined in claim 9 wherein said diamond substrate comprises a thermally stable diamond product.

12. A cutting member as defined in claim 9 wherein said diamond substrate comprises a unitary piece of diamond.

13. A cutting member as defined in claim 9 wherein said diamond substrate comprises a plurality of diamond pieces.

14. A cutting member as defined in claim 13 wherein said film covers joints between said diamond pieces.

15. A cutting member as defined in claim 9 wherein said diamond film is formed by chemical vapor deposition.

16. A cutting member as defined in claim 9 wherein said diamond film also coats exposed sides of said cutting members.

17. A drill bit for drilling a subterranean formation, comprising:

a body member secured to a shank for connecting said drill bit to a drill stem; and a plurality of cutting members disposed on and protruding from said body member, at least one of said cutting members including a substantially planar diamond cutting face comprising a diamond substrate coated with a diamond film, said cutting face having a leading cutting edge for engaging said formation substantially comprising said film at the periphery of said cutting face.

18. A drill bit as defined in claim 17 wherein said diamond substrate comprises a pollycrystalline diamond compact.

19. A drill bit as defined in claim 17 wherein said diamond substrate comprises a thermally stable diamond product.

20. A drill bit as defined in claim 17 wherein said diamond substrate comprises a unitary piece of diamond.

21. A drill bit as defined in claim 17 wherein said diamond substrate comprises a plurality of diamond pieces.

22. A drill bit as defined in claim 21 wherein said film covers joints between said diamond pieces.

23. A drill bit as defined in claim 17 wherein said diamond film is formed by chemical vapor deposition.

24. A drill bit as defined in claim 17 wherein said diamond film also coats exposed sides of said cutting members.

* * * * *